US006710536B2

(12) United States Patent
Yonezawa et al.

(10) Patent No.: US 6,710,536 B2
(45) Date of Patent: Mar. 23, 2004

(54) DISPLAY DEVICE USING FILAMENT

(75) Inventors: Yoshihisa Yonezawa, Chiba (JP); Yukio Ogawa, Chiba (JP); Kazuyoshi Ishikawa, Chiba (JP); Katsutoshi Kogo, Chiba (JP); Satoshi Yoshimura, Chiba (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 89 days.

(21) Appl. No.: 09/954,030

(22) Filed: Sep. 18, 2001

(65) Prior Publication Data

US 2002/0047534 A1 Apr. 25, 2002

(30) Foreign Application Priority Data

Sep. 18, 2000 (JP) ..... 2000-281193

(51) Int. Cl.[7] ..... H01J 1/62; H01J 1/88

(52) U.S. Cl. ..... 313/495; 313/496; 313/497; 313/271; 313/272

(58) Field of Search ..... 313/495–497, 313/513–522, 341, 344, 275, 278, 279, 268, 292, 269, 271, 272, 273; 315/169.3

(56) References Cited

U.S. PATENT DOCUMENTS

| | | | | | |
|---|---|---|---|---|---|
| 3,780,326 | A | * | 12/1973 | Raago | 313/496 |
| 4,047,074 | A | * | 9/1977 | Kishino et al. | 313/497 |
| 4,338,542 | A | * | 7/1982 | Takanashi et al. | 313/446 |
| 5,134,338 | A | * | 7/1992 | Shiratori et al. | 313/422 |
| 5,179,317 | A | * | 1/1993 | Watanabe et al. | 313/496 |
| 5,708,326 | A | * | 1/1998 | Mizohata et al. | 313/495 |
| 6,441,543 | B1 | * | 8/2002 | Yaniv et al. | 313/310 |
| 6,509,693 | B2 | * | 1/2003 | Yonezawa et al. | 315/169.3 |

* cited by examiner

*Primary Examiner*—Nimeshkumar D. Patel
*Assistant Examiner*—Anthony Perry
(74) *Attorney, Agent, or Firm*—Bacon & Thomas, PLLC

(57) ABSTRACT

In a display device including a cathode filament containing a coiled portion and a linear portion thereof and a power feeding member, an end of the coiled portion is fixed to either a substrate made of an insulating material or an insulated support, the power feeding member being installed to contact with the linear portion of the cathode filament.

12 Claims, 10 Drawing Sheets

DISPLAY DEVICE USING FILAMENT

FIELD OF THE INVENTION

The present invention relates to a display device such as a fluorescent display device using a cathode filament; and, more particularly to a cathode filament serving as an electron source for the display device.

BACKGROUND OF THE INVENTION

FIGS. 10A and 10B show schematic internal structures of conventional display devices 800 and 850, respectively. Referring to FIG. 10A, the display device 800 includes a glass substrate 81, a filament 84, a filament support 82 and an anchor 83 for the filament 84. While one end of the filament 84 is fixed to a support member 821 of the filament support 82, the other end of the filament 84 is fixed to a support member 831 of the anchor 83. The height of the filament support 82 and that of the anchor 83 define the height (i.e., a distance between the substrate 81 and top end thereof) of the filament 84 (e.g., see, Japanese utility model laid open publication No. 61-7856).

The support member 831 of the anchor 83 is formed as a plate spring structure. A preset tension force is applied to the filament 84 to prevent the filament from hanging down due to the thermal expansion thereof. Accordingly, the plate spring structure of the support member 831 should be fabricated so that a uniform tension force is applied to the filament 84. Further, the support member 831 should be fabricated with high precision since the support member 831 should fixedly support the filament 84 and maintain the height of the filament 84 at a preset level. The anchor 83 is of a complex structure, requiring a fabrication with high accuracy, and therefore, its fabrication is not easy and the cost thereof is expensive. In addition, it is not easy to make the anchor 83 of a small size, thereby rendering the fabrication of a thin and small display device difficult. FIG. 10B illustrates a schematic internal structure of a conventional display devices 850 which does not use an anchor. Like reference numerals represent like parts in FIGS. 10A and 10B.

Referring to FIG. 10B, the display device 850 includes a glass substrate 81, a left filament support 82, a right filament support 82' and a filament having a coiled portion 842 and a linear portion 841. The filament supports 82 and 82' are fixed at a left and right end portion on top of the substrate 81, respectively. While the left end of the coiled portion 842 is fixed at a support member 821 of the left filament support 82, the right end of the linear portion 841 is fixed at a support member 821' of the right filament support 82'. The coiled portion 842 applies a tension force on the linear portion 841, thereby functioning similar to the anchor 83 in the device 800 shown in FIG. 10A (e.g., see, Japanese utility model laid open publication No. 61-7856).

The device 850 solves the problem of the anchor 83 as shown in FIG. 10A but entails another problem in that a temperature of the coiled portion 842 becomes higher than that of the linear portion 841 during the operation of the display device 850. Namely, for example, during normal turning-on period of the display device 850, the temperature of the coiled portion 842 reaches to about 800° C. while that of the linear portion 841 approaches to about 600° C. Under this condition, the coiled portion 842 emits red light to thereby prevent a normal display operation thereof.

In a manufacturing process of a conventional display device, in order to activate the filament, a flushing is performed at a high voltage. During the flushing, the temperature of the coiled portion 842 reaches to about 1500° C. to 2000° C. while that of the linear portion 841 reaches to 1000° C. As a result, electron emitting source material, e.g., a carbonate, coated on the coiled portion 842 is decomposed and flies around thereby contaminate fluorescent material deposited on an anode. This prevents the display device from operating normally.

SUMMARY OF THE INVENTION

It is, therefore, an object of the present invention to provide a simple and inexpensive display device of high display quality by employing a filament free from above-mentioned problems, i.e., display quality degradation due to red light emission from the coiled portion and contamination of fluorescent material deposited on the anode due to flight of carbonate of a coiled portion, originated from an excessively high temperature of the coiled portion of the filament.

The display device of the present invention overcomes the above-mentioned problems of the conventional display device by adopting a cathode filament having a coiled portion and a linear portion and applying a tension force with the coiled portion and providing electrons only to the linear portion of the filament.

In accordance with a preferred embodiment of the present invention, there is provided a display device including: a cathode filament containing a coiled portion and a linear portion thereof; and a power feeding member, wherein an end of the coiled portion is fixed either to a substrate made of an insulating material or to an insulated support, the power feeding member being installed to contact with the linear portion of the cathode filament.

In accordance with another preferred embodiment of the present invention, there is provided a display device including: a cathode filament containing a coiled portion and a linear portion thereof; and a power feeding wiring for feeding power to the cathode filament, wherein an end of the coiled portion is fixed on either the power feeding wiring or a support member fixed on the power feeding wiring, the coiled portion being insulated.

In accordance with yet another preferred embodiment of the present invention, there is provided a display device including: an anode substrate; a back substrate having either a transparent conductor film or a control electrode formed thereon; a cathode filament installed between the anode substrate and the back substrate, the cathode filament having a coiled portion and a linear portion thereof; and a plurality of spacers fixed to either the transparent conductor film or the control electrode of the back substrate, wherein an end of the coiled portion is fixed either on an insulated support fixed on one of the anode substrate and the back substrate or on one of the anode substrate and the back substrate, a power feeding member being installed to contact with the linear portion of the cathode filament and the substrate on which the end of the coiled portion is fixed being made of insulating material.

In accordance with still yet another preferred embodiment of the present invention, there is provided a display device including: an anode substrate; a back substrate having either a transparent conductor film or a control electrode formed thereon; a cathode filament installed between the anode substrate and the back substrate, the cathode filament having a coiled portion and a linear portion thereof; and a plurality of spacers fixed to either the transparent conductor film or the control electrode of the back substrate, wherein an end of the coiled portion is fixed on either a support member fixed on a power feeding wiring of the cathode filament or the power feeding wiring, the coiled portion being insulated.

BRIEF DESCRIPTION OF THE DRAWINGS

The above and other objects and features of the present invention will become apparent from the following description of the preferred embodiments given in conjunction with the accompanying drawings, wherein.

DETAILED DESCRIPTION OF THE PREFERRED EMBODIMENTS

Figure 1A:
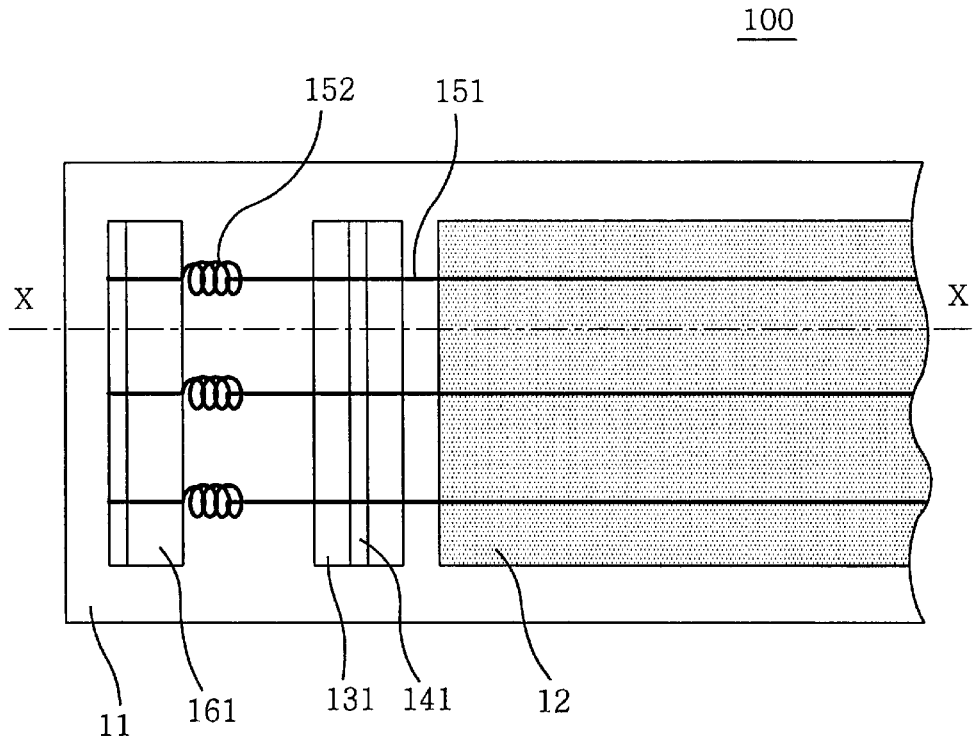
FIGS. 1A and 1B illustrate schematic views of an internal structure of a display device, respectively, in accordance with a first preferred embodiment of the present invention.

Referring to FIGS. 1 to 9, preferred embodiments of the present invention will be described. Like reference numerals in FIGS. 1 to 9 represent like parts. A display device of the present invention overcomes the problems of the conventional display device by providing an electric power only to a linear portion of a filament.

Figure 1B:
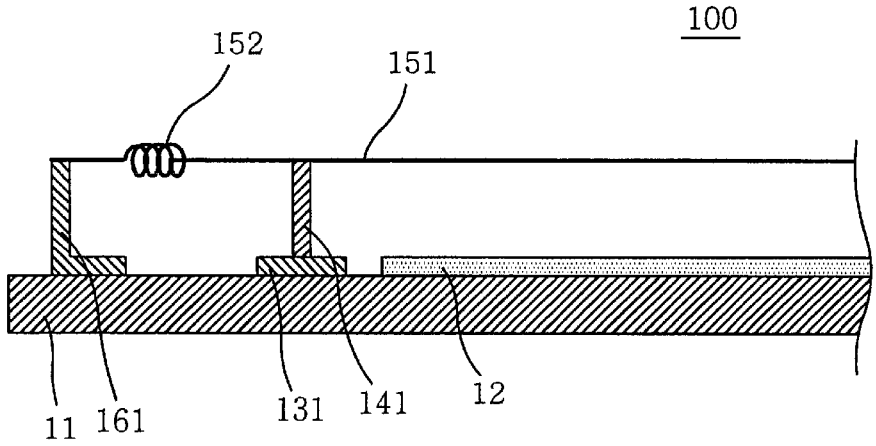

FIG. 1A illustrates a schematic plan view revealing an internal structure of a display device 100 in accordance with a first preferred embodiment of the present invention. FIG. 1B is a cross sectional view taken along a line X—X of FIG. 1A. Referring to FIGS. 1A and 1B, the display device 100 includes a glass substrate 11, a display region 12 thereof, a power feeding wiring 131, e.g., made of aluminum, for feeding power to a filament, a metallic contact member 141 of a plate shape, a coiled portion 152 and a linear portion 151 of the cathode filament and a filament support 161.

The cathode filament having the coiled portion 152 and the linear portion 151 is a wire whose core wire is made of a tungsten or tungsten alloy (e.g., Re—W alloy) and carbonate is deposited on the surface thereof. The metallic contact member 141 serves as a power feeding member for providing electrons from the power feeding wiring 131 to the linear portion 151 of the filament. The metallic contact member 141 also defines the height of the linear portion 151, i.e., a distance between the substrate 11 and a top of the metallic contact member 141.

The filament support 161 is made of metal and electrically insulated. A left end of the coiled portion 152 of the filament is fixed by welding on a top part of the filament support 161 as depicted in FIG. 1B. The height of the filament support 161 is set to be equal to or lower than that of the metallic contact member 141. A bottom end and the top end of the metallic contact member 141 are fixed to the power feeding wiring 131 and the linear portion 151 of the filament, respectively. A right end of the linear portion 151 of the filament is connected to another power feeding wiring (not shown). A voltage is applied on the linear portion 151 of the filament between the power feeding wiring 131 and another power feeding wiring mentioned above. The coiled portion 152 of the filament serves to apply a preset tension force on the linear portion 151 of the filament to prevent the filament from hanging down due to the thermal expansion thereof.

The vertical cross sectional shape of the metallic contact member 141 may be a rectangle, a triangle, a circle or any other polygonal shape. If the vertical cross sectional shape of the contact member is a triangle, heat dissipation of the filament through the metallic contact member 141 can be decreased.

As can be seen from FIGS. 1A and 1B, the left end of the coiled portion 152 is fixed by welding on a top part of the filament support 161 and the linear portion 151 is in contact with top end of the metallic contact member 141. In this condition, since the support 161 is electrically insulated, no voltage is applied on the coiled portion 152. As a result, since the coiled portion 152 is not heated, in the coiled portion 152, there are no emission of red light, decomposition and flight of the carbonate coated thereon.

Figure 2A:
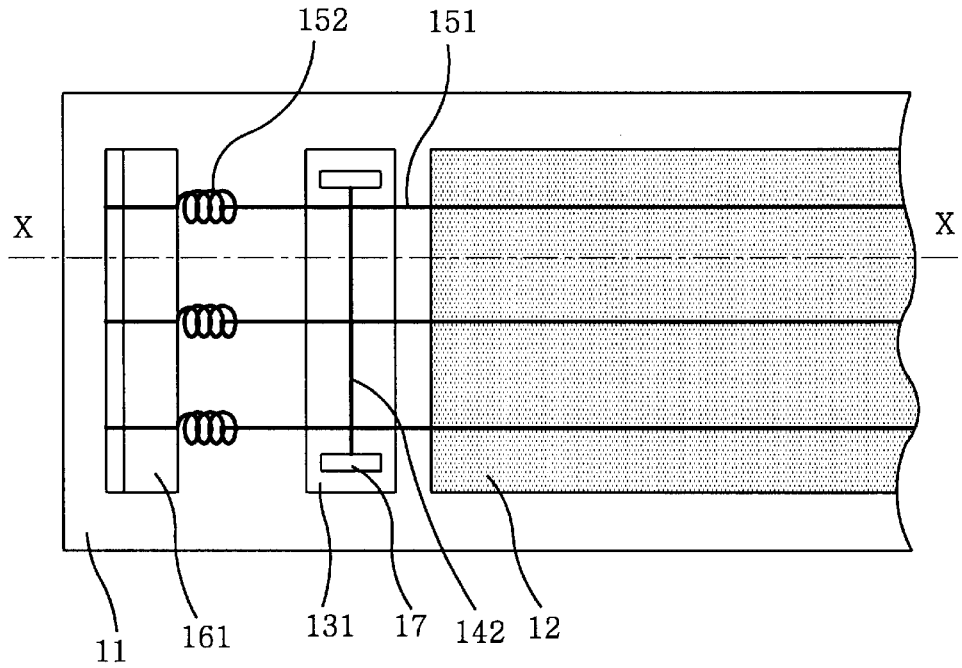
FIGS. 2A and 2B depict schematic views of a structure of another power feeding member of the display device, respectively, in accordance with the first preferred embodiment of the present invention.
Figure 2B:
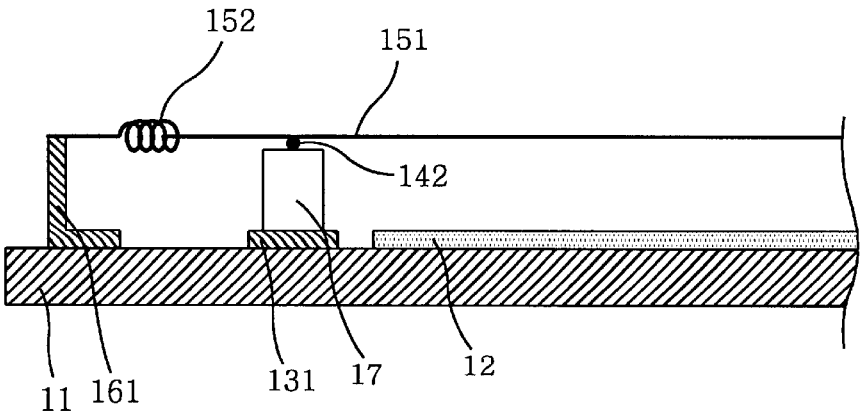

FIG. 2A shows a schematic plan view revealing a structure of another power feeding member of the display device 100. FIG. 2B is a cross sectional view taken along a line X—X of FIG. 2A.

In FIGS. 2A and 2B, a numeral 142 represents a contact wire. A numeral 17 stands for a support member of the contact wire 142. The support member 17 made of metal is fixed to a power feeding wiring 131. A linear portion 151 of a filament is in contact with the contact wire 142. Electrons are fed from the power feeding wiring 131 to the linear portion 151 of the filament through the contact wire 142. In this internal structure of the display device 100, only the support member 17 and the contact wire 142 act as a power feeding member, thereby simplifying the structure of the display device 100. Further, since the heat capacity of the wire 142 is smaller than that of a metal plate, the heat dissipation therefrom is reduced.

Figure 3A:
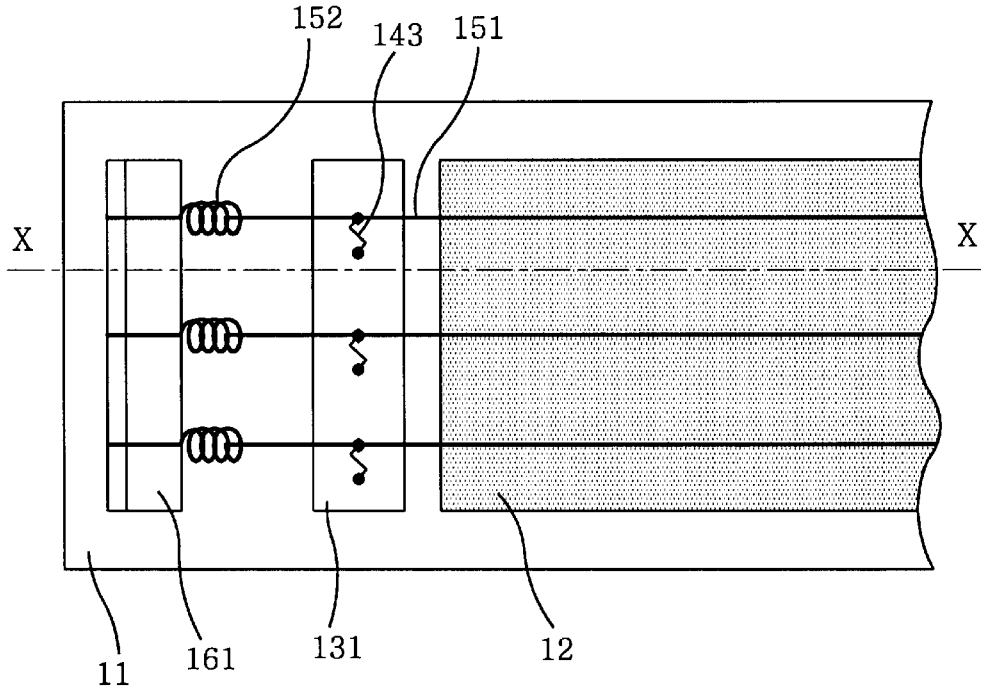
FIGS. 3A and 3B depict schematic views of a structure of yet another power feeding member of the display device, respectively, in accordance with the first preferred embodiment of the present invention.
Figure 3B:
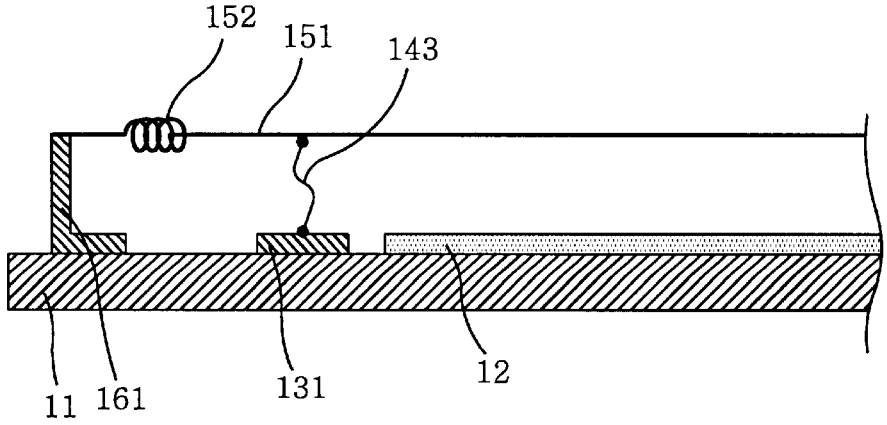

FIG. 3A depicts a schematic plan view revealing a structure of yet another power feeding member of the display device 100. FIG. 3B is a cross sectional view taken along a line X—X of FIG. 3A.

In FIGS. 3A and 3B, a numeral 143 stands for a metal wire. One end of the metal wire 143 is connected to a linear portion 151 of a filament while the other end thereof is connected to a power feeding wiring 131. Electrons are fed from the power feeding wiring 131 to the linear portion 151 of the filament through the metal wire 143. The height of the linear portion 151 of the filament is defined as the height of a support 161.

In this internal structure of the display device 100, only the metal wire 143 acts as a power feeding member to the linear portion 151 of the filament, thereby simplifying the structure of the display device 100. Further, since the heat capacity of the metal wire 143 is smaller than that of a metal plate, the heat dissipation therefrom decreases.

Figure 4A:
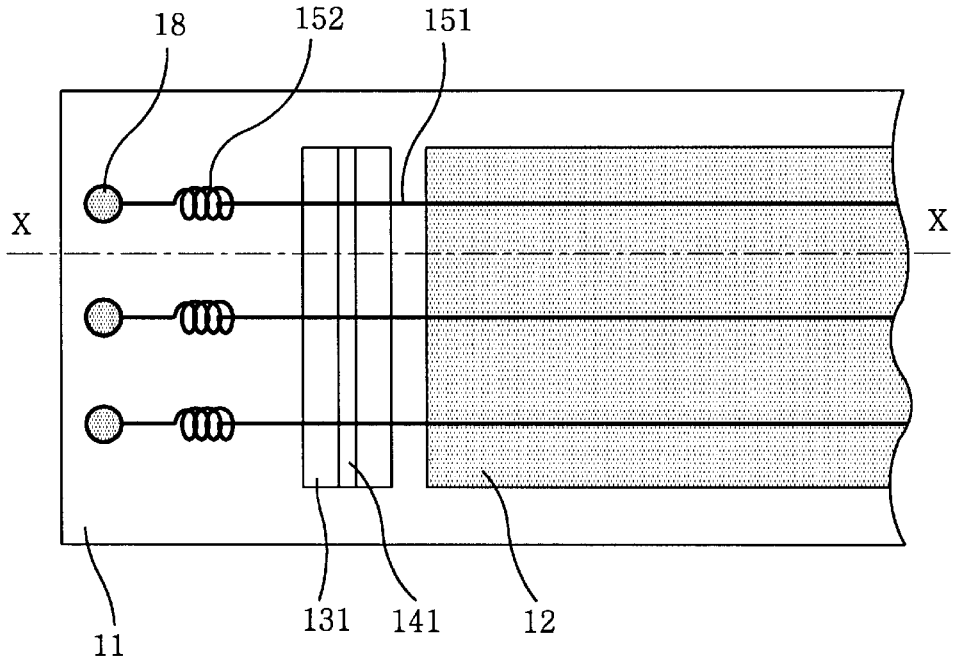
FIGS. 4A and 4B present another example of means for fixing a left end of a filament instead of a filament support in FIG. 1.
Figure 4B:
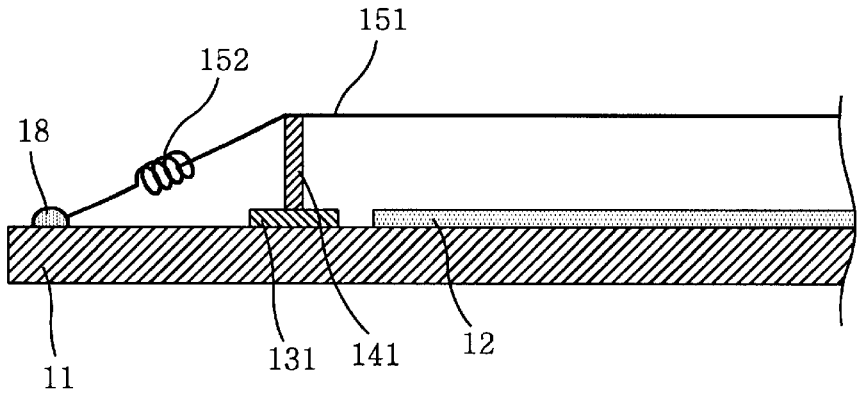

FIGS. 4A and 4B present another example of means for fixing the left end of the filament instead of the filament support 161 in FIG. 1. In FIG. 4, a numeral 18 represents a fixing part formed by employing a glass paste for fixing a left end of a coiled portion 152 of the filament. In this case, the height of a linear portion 151 of the filament is defined as the height of a metallic contact member 141 as viewed in FIG. 4B. This configuration employing the fixing part 18 is simpler than that using the filament support 161 illustrated in FIG. 1B which requires a very accurate fabrication, entailing a high cost. Further, the fixing procedure thereof becomes easy by employing the fixing part 18.

Figure 5A:
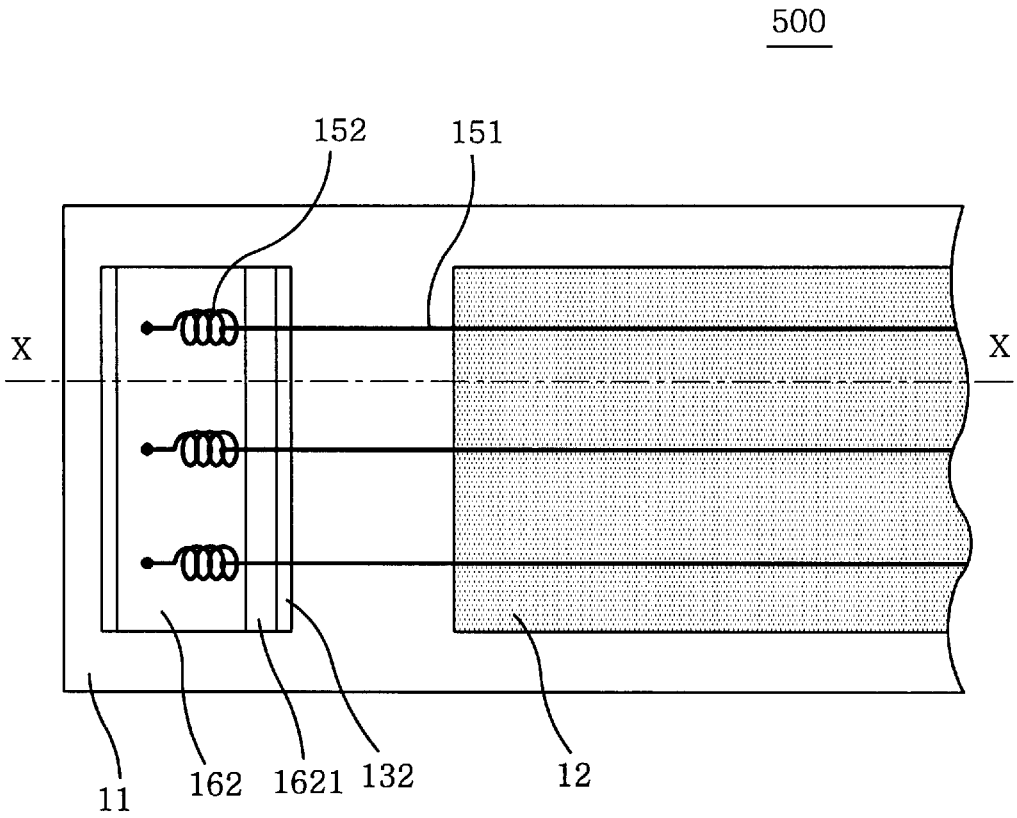
FIGS. 5A and 5B describe schematic views of an internal structure of a display device, respectively, in accordance with a second preferred embodiment of the present invention.
Figure 5B:
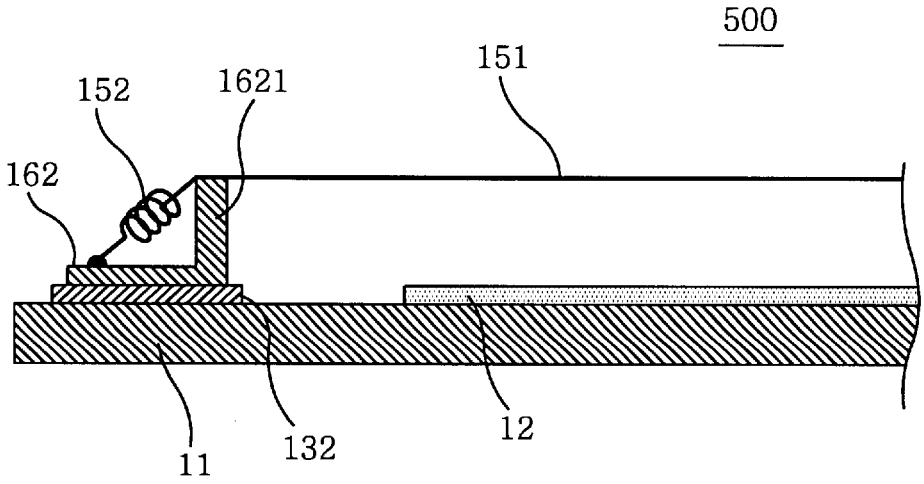

FIG. 5A illustrates a schematic plan view revealing an internal structure of a display device 500 in accordance with a second preferred embodiment of the present invention. FIG. 5B is a cross sectional view taken along a line X—X of FIG. 5A.

The display device 500 overcomes the problems of the conventional display device by insulating a coiled portion of a filament and providing an electric power only to a linear portion of the filament.

Referring to FIGS. 5A and 5B, the display device 500 includes a glass substrate 11, a display region 12 thereof, a power feeding wiring 132 for feeding power to a filament, a coiled portion 152 and a linear portion 151 of the filament, a metallic contact member 1621 and a filament support 162. The filament support 162 made of a metal also serves as a power feeding member for feeding power from the power feeding wiring 132 to the linear portion 151 of the filament.

A left end of the coiled portion 152 of the filament is fixed by welding on top of the filament support 162 as depicted in FIG. 5B. Since the coiled portion 152 is insulated by the filament support 162, electrons are fed only to the linear portion 151 of the filament through the filament support 162 fixed on the power feeding wiring 132. As a result, the coiled portion 152 of the filament is not heated. The height of the linear portion 151 of the filament is defined as the height of a vertical part 1621 of the support 162.

In this case, since the support 162 serves as a support member for the filament and a power feeding member to the filament, a space needed to install the power feeding wiring 132 between the filament support 162 and the display region 12 is greatly saved. Further, the filament fixing process can be performed with ease.

Figure 6A:
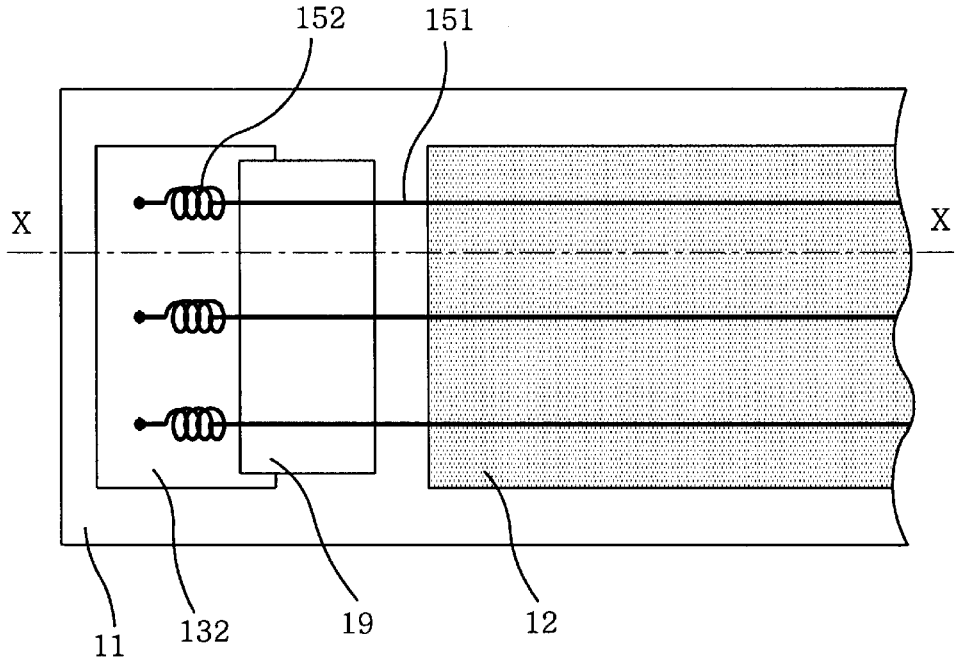
FIGS. 6A and 6B illustrate schematic views revealing another internal structure of a unit for insulating the coiled portion shown in FIGS. 5A and 5B.
Figure 6B:
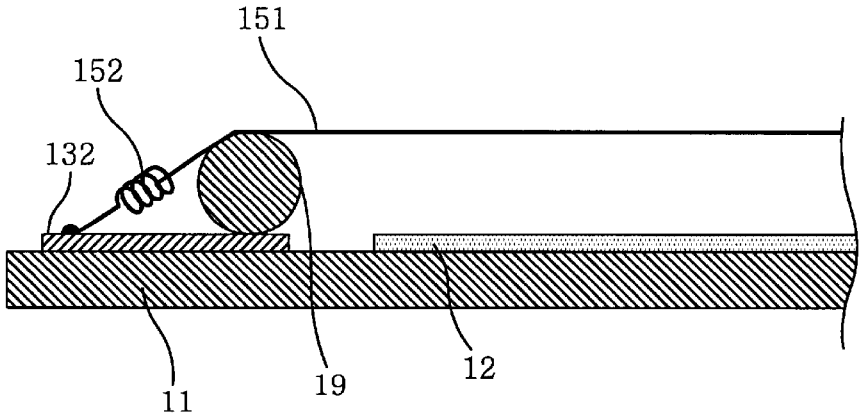

FIG. 6A illustrates a schematic top view revealing another internal structure of the unit, i.e., the support 162, for insulating the coiled portion 152 shown in FIGS. 5A and 5B. FIG. 6B is a cross sectional view taken along a line X—X of FIG. 6A. In FIGS. 6A and 6B, a numeral 19 indicates a cylindrical conductor or a cylindrical insulator having conductor material deposited thereon.

A left end of a coiled portion 152 of a filament is fixed on top of a power feeding wiring 132 as depicted in FIG. 6B. Since the coiled portion 152 is insulated by means of the power feeding wiring 132 and the cylindrical conductor 19, electrons are fed only to the linear portion 151 of the filament. This is similar to the case of FIGS. 5A and 5B. The height of the linear portion 151 of the filament is defined as the height of the cylindrical conductor 19.

In this case, since the cylindrical conductor 19 is fixed on the power feeding wiring 132, the structures of the support and the power feeding wiring become simple and space for installation of the power feeding member between the filament support 162 and the display region 12 is saved. Further, the filament fixing process can be performed with ease.

Figure 7A:
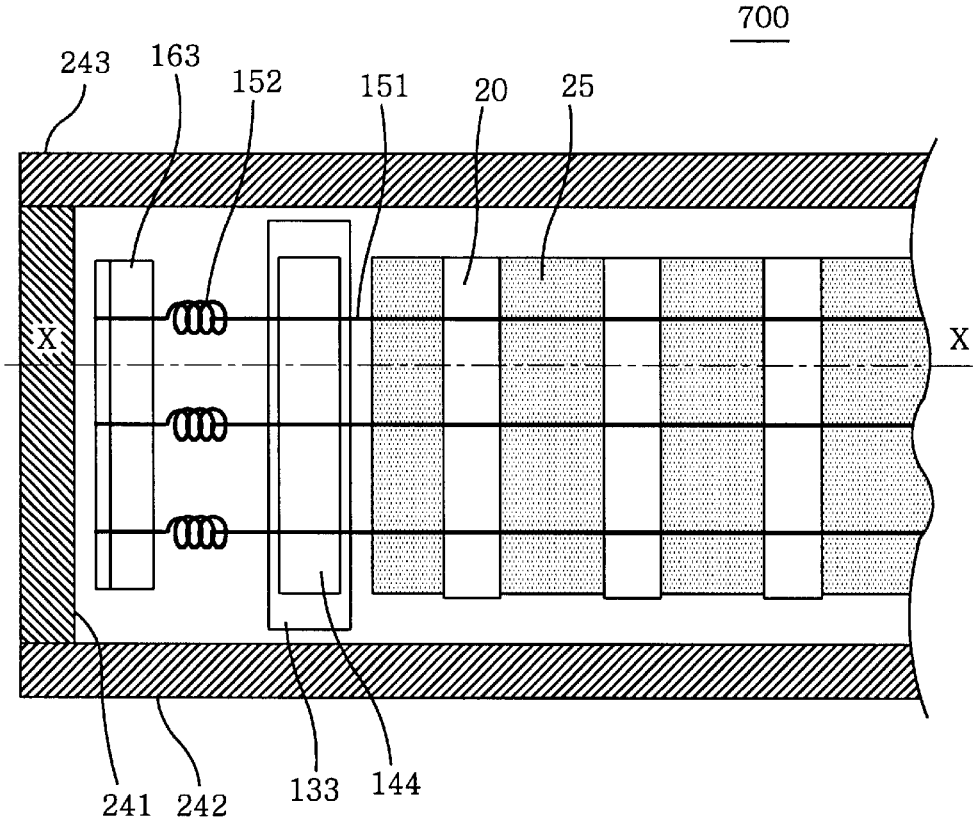
FIGS. 7A and 7B set forth schematic views revealing an internal structure of a display device, respectively, in accordance with a third preferred embodiment of the present invention.
Figure 7B:
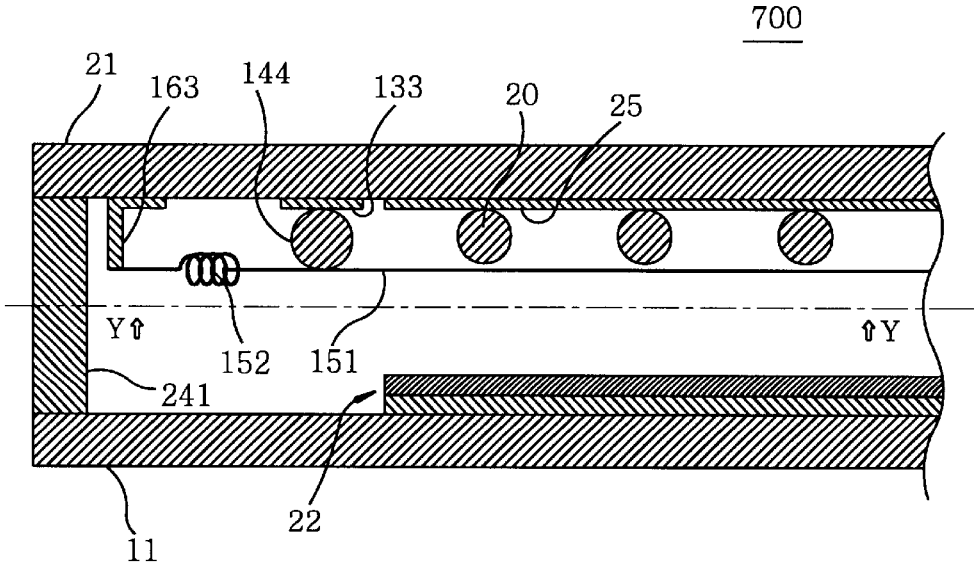

FIG. 7A illustrates a schematic plan view revealing an internal structure of a display device 700 in accordance with a third preferred embodiment of the present invention. FIG. 7B is a cross sectional view taken along a line X—X of FIG. 7A. FIG. 7A is a plan view taken along a line Y—Y of FIG. 7B.

Referring to FIGS. 7A and 7B, the display device 700 includes a glass anode substrate 11, a power feeding wiring 133, a cylindrical conductor 144, a linear portion 151 of a filament, a coiled portion 152 of the filament, a filament support 163 made of a metal, a glass fiber 20 serving as a spacer, a back glass plate 21, an anode 22 having a fluorescent layer formed thereon, a transparent conductor film (or a control electrode) 25 and side glass plates 241, 242 and 243. The anode substrate 11, the back plate 21 and the side glass plates 241 to 243 constitute a sealed vacuum vessel. A bottom part of the support 163 is fixed to the back plate 21. A left end of the coiled portion 152 is fixed by welding to a top part of the support 163.

The cylindrical conductor 144 serves as a power feeding member for feeding power from the power feeding wiring 133 to the linear portion 151 of the filament. The cylindrical conductor 144 defines the height of the linear portion 151 of the filament. The transparent conductor film 25 aims for electromagnetic shielding. Instead of the transparent conductor film, the part represented by the numeral 25 may be a control electrode for controlling electrons emitted from the filament to the anode.

The glass fiber 20 is fixed to the transparent conductor film 25 or the control electrode 25. If the control electrode 25 is divided into electrode parts, it is preferable that the glass fiber 20 is fixed between the electrode parts. Both cases discussed in the above are considered in this description. The glass fiber 20 can be made of any material which has insulating characteristic.

In a thin display device, since spacing between the linear portion 151 of the filament and an inner surface of the back substrate 21 and that between the linear portion 151 and an inner surface of the anode substrate 11 range about 1.0 mm and about 1.4 mm, respectively, if a vibration is applied on the display device, the linear portion 151 may contact with the transparent conductor film or the control electrode 25 or other electrode. A glass fiber 20 ameliorates this contact problem.

Meanwhile, since heat is dissipated from the linear portion 151 when the linear portion 151 of the filament contacts with the glass fiber 20, thereby deteriorating the electron emission capability thereof, it is preferable that there is no contact between the linear portion 151 and the glass fiber 20 under a normal state, i.e., a state that there is no vibration thereof. Accordingly, a diameter of the glass fiber 20 is equal to or preferably smaller than that of the cylindrical conductor 144.

In this preferred embodiment, in a thin display device employing a glass fiber as a spacer, a coiled portion 152 of a filament is used as a unit for applying tension force to the filament and a cylindrical conductor 144 for electron feeding is installed between the coiled portion 152 and the linear portion 151, thereby removing heat dissipation from the coiled portion 152.

Figure 8A:
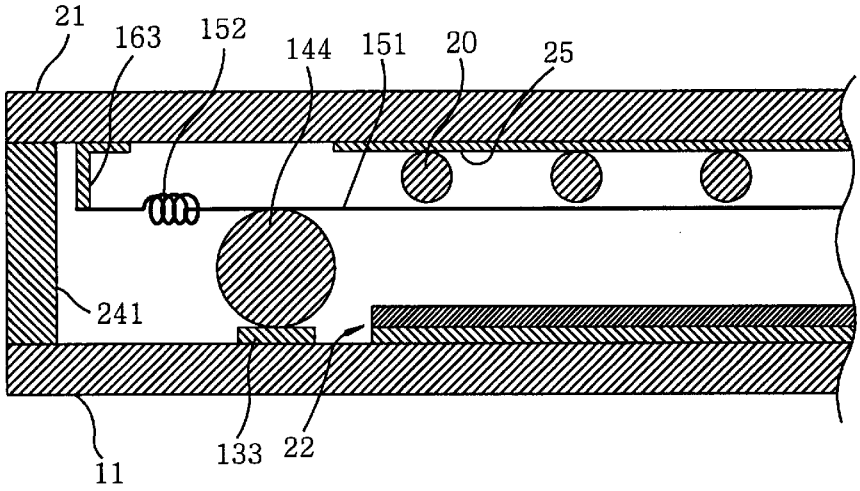
FIGS. 8A to 8C represent another example of a cylindrical conductor and a support shown in FIG. 7.
Figure 8B:
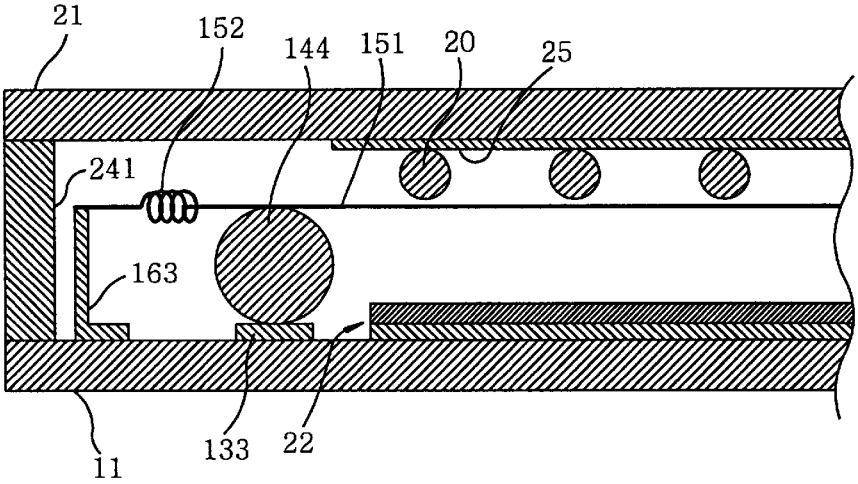
Figure 8C:
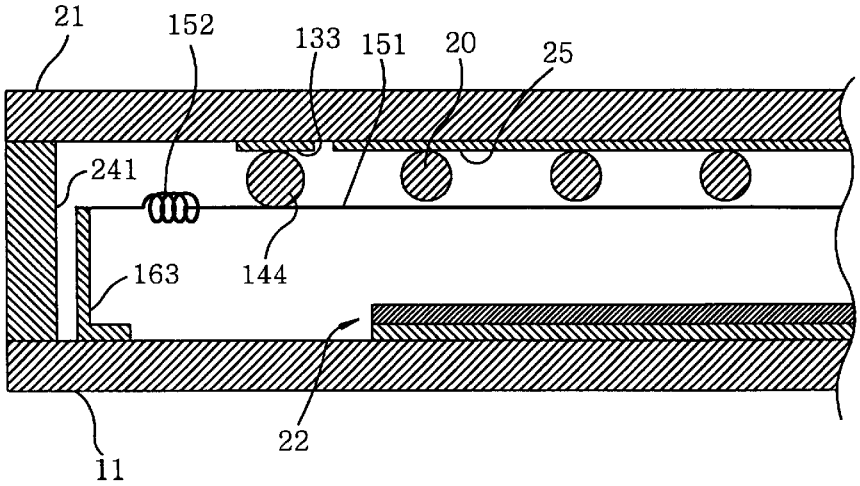

FIGS. 8A to 8C represent another example of the cylindrical conductor 144 and the support 163 shown in FIG. 7.

In FIG. 8A, the support 163 is fixed to a back plate 21 while a power feeding wiring 133 and a cylindrical conductor 144 are installed on an anode substrate 11 in sequence. In FIG. 8B, the support 163 is fixed to the anode substrate 11 while the power feeding wiring 133 and the cylindrical conductor 144 are also installed on the anode substrate 11 in sequence. In FIG. 8C, the support 163 is fixed to the anode substrate 11 while the power feeding wiring 133 and the cylindrical conductor 144 are installed on the back plate 21 in sequence.

Figure 9A:
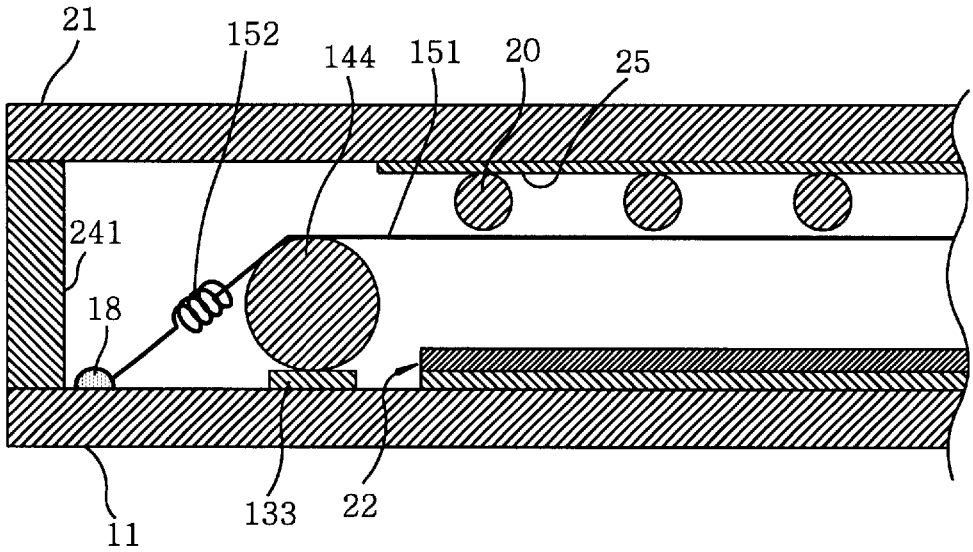
FIGS. 9A and 9B present another example of means for fixing a left end of a filament instead of a filament support in FIG. 7.
Figure 9B:
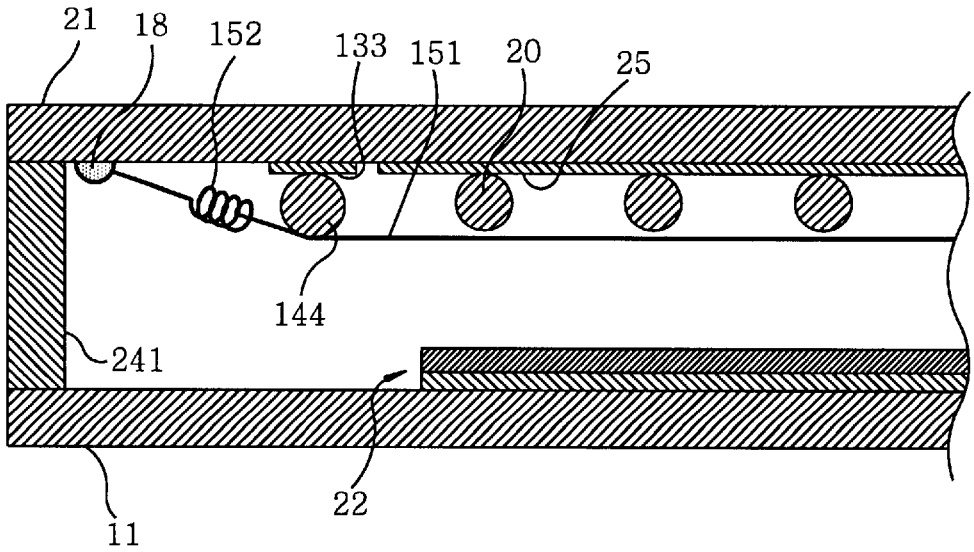
Figure 10A:
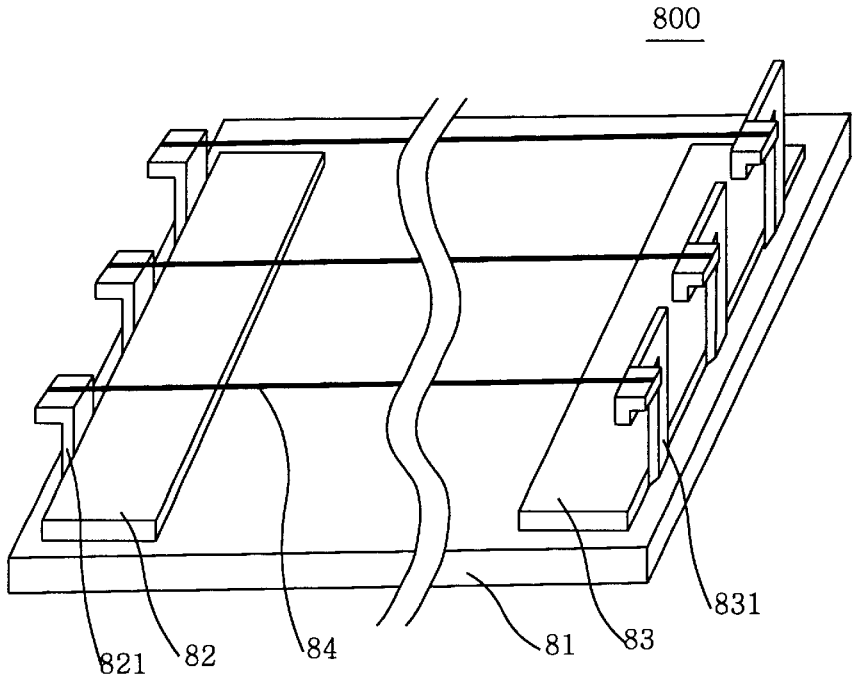
FIG. 10A (PRIOR ART)
FIGS. 10A and 10B show internal structures in accordance with conventional display devices, respectively.
Figure 10B:
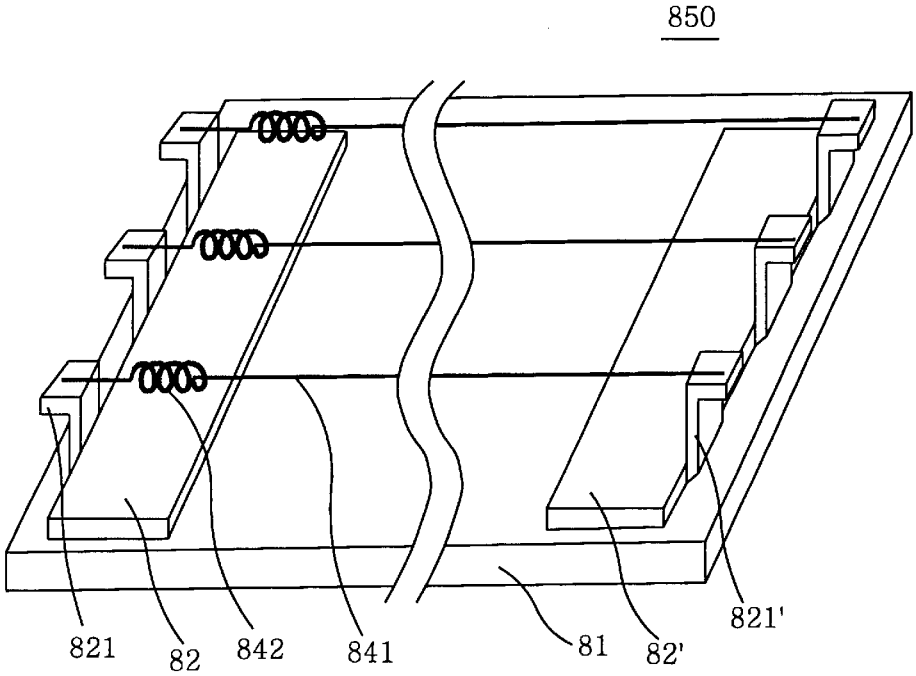
FIG. 10B (PRIOR ART)

FIGS. 9A and 9B present another example of means for fixing a left end of the coiled portion 152 of the filament instead of the filament support 163 in FIG. 7. In FIG. 9A, a left end of a coiled portion 152 of a filament is directly fixed to an anode substrate 11; and an electron feeding wire 133 and a cylindrical conductor 144 are also fixed to the anode substrate 11. The height of a linear portion 151 of the filament is defined as that of the cylindrical conductor 144. In FIG. 9B, a left end of a coiled portion 152 of a filament is directly fixed to a back plate 21; and an electron feeding wire 133 and a cylindrical conductor 144 are also fixed to the back plate 21.

A structure of a display device is determined or selected based on conditions for electrodes and spaces of the wiring with reference to the structures thereof illustrated in FIGS. 7 to 9.

In FIGS. 7 to 9, the end of the coiled portion 152 of the filament is insulated to thereby provide electrons only to the linear portion 151 thereof. This is also applied to the cases of FIGS. 5 and 6 for insulating the end of the coiled portion 152 of the filament.

As discussed in the above, since the display device of the present invention uses a cathode filament having a coiled portion and a linear portion thereof, it is not necessary to use a high cost anchor of high fabrication accuracy.

The display device of the present invention uses a filament having a coiled portion and a linear portion thereof, wherein an end of the coiled portion is insulated and a power feeding member is installed to contact with the linear portion. As a result, electrons are not fed to the coiled portion but fed only to the linear portion. Accordingly, since the coiled portion is not heated, the emission of red light therefrom deteriorating the display function, decomposition and flight of the carbonate coated thereon contaminating the display device are avoided. Further, since the power feeding member can be used as a member for defining the height of the filament, thereby realizing the display device without a high cost support of a complex shape.

Since in the display device of the present invention the end of the coiled portion is insulated to avoid feeding electrons to the coiled portion, there can be obtained a same effect as that obtained when the power feeding member is installed in the linear portion. Further, in this case, there is no need to install the support to fix the end of the coiled portion and the power feeding member simultaneously, thereby saving necessary components and simplifying the structure of the display device.

Even though the display device of the present invention uses a filament having a coiled portion and a linear portion thereof, electrons are not fed to the coiled portion. As a result, since there entails no power consumption in the coiled portion, the power consumption of the display device is decreased.

The display device of the present invention avoids heating of the coiled portion by employing the filament having the coiled portion and the linear portion thereof, thereby rendering the display device slimmer by using a space such as a glass fiber.

While the present invention has been described with respect to certain preferred embodiments only, other modifications and variations may be made without departing from the scope of the present invention as set forth in the following claims.

What is claimed is:

1. A display device comprising:

a cathode filament including a coiled portion and a linear portion; and a power feeding member for feeding power to the cathode filament, wherein an end of the coiled portion is fixed either to a substrate made of an insulating material or to an insulated support, and the power feeding member is connected to a contact point of the cathode filament, the coiled portion being located between the contact point and the end of the cathode filament, to thereby exclude the coiled portion from being provided with the power.

2. The display device of claim 1, wherein the power feeding member is fixed on a power feeding wiring.

3. The display device of claim 2, wherein the power feeding member includes a metallic contact member making contact with the contact point of the cathode filament.

4. The display device of claim 2, wherein the power feeding member includes a metallic support member and a contact wire, the contact wire making contact with the metallic support member and the contact point of the cathode filament.

5. The display device of claim 2, wherein the end of the coiled portion is fixed to the insulated support and the power feeding member is a conductive wire fixed on the power feeding wiring.

6. The display device of claim 3, wherein the height of the linear portion is defined as that of the metallic contact member.

7. The display device of claim 5, wherein the height of the linear portion is defined as that of the insulated support.

8. A display device comprising:

an anode substrate;

a back substrate having either a transparent conductor film or a control electrode formed thereon;

a cathode filament installed between the anode substrate and the back substrate, the cathode filament having a coiled portion and a linear portion thereof; and a plurality of spacers fixed to either the transparent conductor film or the control electrode of the back substrate, wherein an end of the coiled portion is fixed either on an insulated support fixed on one of the anode substrate and the back substrate or on one of the anode substrate and the back substrate, a power feeding member being installed to contact with the linear portion of the cathode filament and the substrate on which the end of the coiled portion is fixed being made of insulating material.

9. A display device comprising:

an anode substrate;

a back substrate having either a transparent conductor film or a control electrode formed thereon;

a cathode filament installed between the anode substrate and the back substrate, the cathode filament having a coiled portion and a linear portion thereof; and a plurality of spacers fixed to either the transparent conductor film or the control electrode of the back substrate, wherein an end of the coiled portion is fixed on either a support member fixed on a power feeding wiring of the cathode filament or the power feeding wiring, the coiled portion being insulated.

10. A display device comprising:

a cathode filament including a coiled portion and a linear portion;

a power feeding wiring for feeding power to the cathode filament, and a metallic support member fixed on the power feeding wiring to be in electrical contact with the power feeding wiring, wherein an end of the cathode filament is fixed at a part of the metallic support member to be in electrical contact therewith and a contact point of the cathode filament is in electrical contact with another part of the metallic support member such that the coiled portion is located between the end and the contact point of the cathode filament, to thereby exclude the coiled portion from being provided with the power.

11. A display device comprising:

a cathode filament including a coiled portion and a linear portion;

a power feeding wiring for feeding power to the cathode filament, and a conductive member provided on the power feeding wiring to be in electrical contact therewith, wherein an end of the cathode filament is fixed on the power feeding wiring to be in electrical contact therewith and the conductive member is in electrical contact with a contact point of the cathode filament such that the coiled portion is located between the end and the contact point of the cathode filament, to thereby exclude the coiled portion from being provided with the power.

12. The display device of claim 11, wherein the conductive member has a cylindrical shape.

* * * * *